US007134652B2

(12) United States Patent
Smith

(10) Patent No.: US 7,134,652 B2
(45) Date of Patent: Nov. 14, 2006

(54) TAIL VISE

(76) Inventor: James D Smith, 1900 Market St., Ste. 800, Philadelphia, PA (US) 19103

( * ) Notice: Subject to any disclaimer, the term of this patent is extended or adjusted under 35 U.S.C. 154(b) by 182 days.

(21) Appl. No.: 10/916,362

(22) Filed: Aug. 11, 2004

(65) Prior Publication Data

US 2006/0033254 A1 Feb. 16, 2006

(51) Int. Cl.
*B25B 1/10* (2006.01)

(52) U.S. Cl. ..... 269/244

(58) Field of Classification Search ..... 144/286.1, 144/278.1, 307, 250–253; 269/244
See application file for complete search history.

(56) References Cited

U.S. PATENT DOCUMENTS 1,596,169 A * 8/1926 Follmer ..... 144/307
4,375,827 A * 3/1983 Ignjatic ..... 144/286.1

* cited by examiner

*Primary Examiner*—Robert C. Watson
(74) *Attorney, Agent, or Firm*—National IP Rights Center

(57) ABSTRACT

A tail vise is disclosed. The novel tail vise includes a longitudinally extending guide secured to or integrated into a surface, which has an axially threaded bore to receive a threaded vise rod, a compression housing slideably surrounding said longitudinally extending guide, and a threaded vise rod connected to said compression housing, threaded through the axially threaded bore of said longitudinally extending guide. The compression housing is slideably attached to the guide and spinably secured to the threaded vise rod, and therein serves as the means of compression.

4 Claims, 1 Drawing Sheet

TAIL VISE

FIELD OF THE INVENTION

The present invention relates to the field of workbench vises, and in particular to a tail vise.

BACKGROUND OF THE INVENTION

Traditional European-style workbenches are considered to be one of the most coveted items by experienced woodworkers. These large workbenches have a solid hardwood construction and large tool wells, as well as their most identifiable feature, large integrated vises. One of the vises usually integrated into these workbenches is a tail vise, which is a special end vise used to accommodate most any woodworking project. As a result, numerous variations on workbench vises have been introduced into the market to aid woodworkers.

A number of patents have issued related to tail vises and the like. U.S. Pat. No. 4,235,429 discloses a self-contained vise and support assembly including two jaw members urged together by screw or other appropriate devices to clamp a desired work piece there between. The jaw members comprise one member rigidly fixed to the vise base and one movable member pivotably mounted upon the vise body capable of freely changing position and orientation relative to the fixed jaw member in order to accommodate a multitude of different work pieces. The vise itself is supported by a support assembly permitting free movement and adjustment about a plurality of axes. The support assembly possesses the capability of being mounted or affixed to a large number of existing work tables or surfaces for greater versatility of use.

U.S. Pat. No. 6,170,814 discloses a method for attaching a jaw to a vise-like workholding apparatus. The method includes placing the jaw member onto a support member of the workholding apparatus in a first direction that is perpendicular to a worksurface of the workholding apparatus. The jaw member is placed such that at least a portion of the support member is received within a cavity in the jaw member in a first released position. The method also includes applying a first axial force in a first axial direction to the jaw member to cause the jaw member to move axially in the first axial direction to a second position wherein it is retained on the support member.

U.S. Pat. No. 6,032,938 discloses a carver's vise for holding a workpiece to be carved includes a base mounted to a workbench, a clamp mechanism, a mounting plate, and a mounting plate shaft clamped to a base connector by the clamp mechanism. The base includes an angled portion that extends upwardly from a rear of the base to a point near the front of the base closer to the user. The clamp mechanism includes a clamp head holding the mounting plate shaft against the base connector, a clamp shaft located in a bore of the base connector, and a handle that tightens or releases the clamp from the base connector. When the handle releases the clamp head, the mounting plate is free to rotate about the clamp shaft. Grooves in the base connector and an O-ring allow the mounting plate to rotate in discrete angular increments. The mounting plate may also rotate about the clamp shaft and move back and forth through the clamp head.

U.S. Published Patent Application discloses a workbench which includes a frame, a bench surface on the frame with the bench surface including at least two members, one of which is movable along the frame for clamping a workpiece between the members. A mechanism for moving the member includes two screws coupled with the members. The two screws are spaced with the member for moving the member upon rotation of the screws. A sprocket is coupled with each of the screws. A transmission belt or chain is coupled with the sprockets. At least one handle is coupled with one of the screws to rotate the screws. At least one clutch is coupled with the at least one screw to limit clamping pressure on the workpiece. The clutch enables rotation of one screw with respect to the other screw so that workpieces may be clamped between the members and clamping of the workpiece may be accomplished by rotation of the screws with one hand of the operator. Also, a guard may be present which covers the transmission belt or chain. The handle may include a hub, a straight portion, and curved portion extending from the straight portion. A knob extends from the curved portion.

U.S. Published Patent Application 20020050673 discloses vise jaw plates and matching work piece holders cooperate to reliably secure an odd-shaped object in a preferred orientation between the plates. At least one of a plurality of work piece holders are disposed throughout the jaw in an orthogonal pattern with the plate holes precisely aligned in rows and columns and spaced apart a same distance such that a selected work piece holder with one or more mount posts matching the jaw holes is mountable equally well throughout the plate.

There is a need however, for a tail vise that can be more securely fastened to and cleanly integrated into a workbench, and one which will have a greater surface area between screw and thread.

OBJECTS AND SUMMARY OF THE INVENTION

It is an object of the present invention to provide a tail vise that produces a secure and strong means of fastening objects to a workbench.

It is a further object of the present invention to provide a tail vise that can be easily set up and used.

It is a yet a further object of the present invention to provide a tail vise that integrates seamlessly into the form of a traditional workbench.

In accordance with a first aspect of the present invention, a novel tail vise guide is disclosed. The novel tail vise guide includes a longitudinally extending guide secured to a surface, which has an axially threaded bore to receive a threaded vise rod. The novel tail vise guide is secured to the surface by fasteners, adhesives, magnets, clamps, or is simply an integrated part of the surface.

In accordance with another aspect of the present invention, a novel tail vise is disclosed. The novel tail vise includes a longitudinally extending guide secured to a surface, which has an axially threaded bore to receive a threaded vise rod, a compression housing slideably surrounding said longitudinally extending guide, and a threaded vise rod connected to said compression housing, threaded through the axially threaded bore of said longitudinally extending guide. The novel tail vise guide is secured to the surface by fasteners, adhesives, magnets, clamps, or is simply an integrated part of the surface. The compression housing is slideably attached to the guide, is spinably secured to the threaded vise rod, and therein serves as the means of compression.

In accordance with yet another aspect of the present invention, a novel tail vise disclosed. The novel tail vise includes a longitudinally extending guide screwed to a workbench, having a top, bottom, first, second, front, and back side, as well as an axially threaded bore extending from the first side to the second side to receive a threaded vise rod, a compression housing, having a first, second, and center portion, with a center channel slideably connecting to said guide, and a threaded vise rod connected to said compression housing and threaded through the axially threaded bore of said guide from the first side to the second side. Said guide tapers on its top and bottom sides from its front side, at the guide's farthest point from the worktable, to its back side, where the guide is secured to the workbench. The compression housing's center portion's channel surrounds the guide's tapered shape and is capped on both ends by the first and second portion, thereby allowing the compression housing to only slideably travel along the guide from its first side to its second side. Finally, the threaded vise rod is connected to the compression housing through the use of a plate that allows the vise rod to spin freely, but fixes the compression housing's position in relation to the vise rod.

BRIEF DESCRIPTION OF THE DRAWINGS

The foregoing summary, as well as the following detailed description of a preferred embodiment of the present invention will be better understood when read with reference to the appended drawings, wherein.

DETAILED DESCRIPTION OF THE PREFERRED EMBODIMENT

Figure 1:
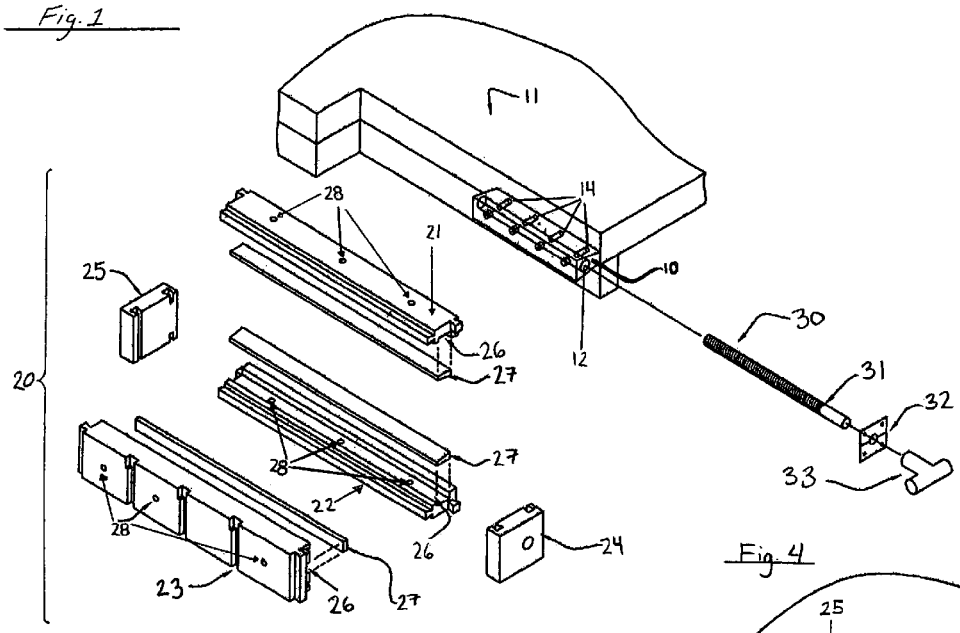
FIG. 1 is an exploded isometric view of a tail vise in accordance with the present invention.
Figure 2:
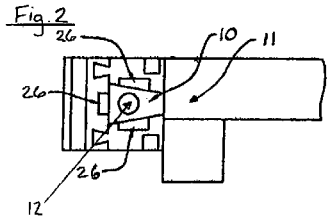
FIG. 2 is a partial cross sectional view of the tail vise of FIG. 1.
Figure 3:
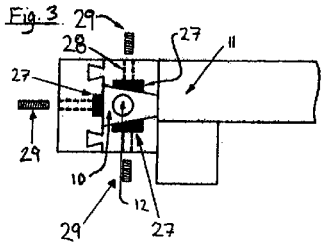
FIG. 3 is a partial cross sectional view of the tail vise of FIG. 1.
Figure 4:
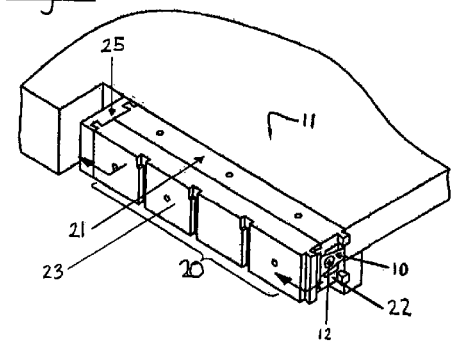
FIG. 4 is an isometric view of a tail vise in accordance with the present invention.

Referring now to the drawings wherein like reference numerals refer to the same components across the several views, and in particular to FIG. 1, there is shown a tail vise. The tail vise includes a longitudinally extending guide 10 secured to a workbench 11, having an axially threaded bore 12 to receive a threaded vise rod 30. In a most preferred embodiment, the guide 10 tapers on its top and bottom sides from its front side, at the guide's farthest point from the worktable, to its back side, where the guide is secured to the workbench 11. The guide 10 is also screwed into the side of the workbench 11 through four screw holes 14 within the guide.

The tail vise further includes a compression housing 20 slideably surrounding the guide 10. The compression housing provides compression restraint against this guide. In the preferred embodiment, the compression housing and guide would be constructed from a UHWM plastic. In alternate embodiments, the compression housing and guide would be constructed from wood, plastic, metal, composite materials, or any other reasonable material known to one versed in the prior art. The compression housing 20 is comprised of a top portion 21, bottom portion 22, front portion 23, first side portion 24, and a second side portion 25. The top portion 22 seats on the topside of the guide 10 and is secured to the front portion 23 by dovetails. The bottom portion 22 seats on the bottomside of the guide 10 and is secured to the front portion 23 by dovetails.

The top portion 21, center portion 22, and bottom portion 23 have shallow channels/dados 26, which accept loose angled pieces 27, as well as a series of threaded inserts 28 that accept Allen screws 29, which are tightened to compress the loose angled pieces 27 against the guide 10 thereby locking the compression housing 20 in place. The first side portion 23 has a through-hole, which accepts a threaded vise rod 30 and is secured to the top portion 21, bottom portion 22, and front portion 23 by dovetails. The second side portion 23 is secured to the top portion 21, bottom portion 22, and front portion 23 by dovetails. The fact that the guide is angled facilitates the operation of the invention.

The threaded vise rod 30 is screwed into the axially threaded bore 12 of the guide 10 and is connected to the compression housing's first side portion 24 by a plate 32, which is screwed to the first side portion 24 and seats within a groove 31 in the threaded vise rod 30. A fixed handle 33 is connected to the threaded vise rod 30, and when turned, will move the compression housing 20 to a desired location, where the Allen screws 29 can be tightened and the vise will remain fixed.

The present invention thus provides a system whereby the compression housing moves relative to the guide and provides a maximal surface area of contact for the screw. The vise of the present invention can be constructed form a variety of materials.

The present invention has been described with reference to the attached preferred embodiment. The true nature and scope of the present invention is to be determined with reference to the claims appended hereto.

The invention claimed is:

1. A tail vise comprising:

a longitudinally extending guide screwed to a workbench, said guide having a top, bottom, first, second, front and back side, as well as an axially threaded bore extending from the first side to the second side to receive a threaded vise rod;

a compression housing, having a first, second and center portion, with a center channel slideably connecting to said guide; and a threaded vise rod connected to said compression housing and threaded through the axially threaded bore of said guide from the first side to the second side;

the guide tapering on its top and bottom sides from its front side, at the guide's farthest point from the worktable, to its back side, where the guide is secured to the workbench.

2. The tail vise of claim 1, wherein the compression housing center portion's channel surrounds the guide's tapered shape and is capped on both ends by the first portion, having a hole to accept a vise rod, and a solid second portion, thereby allowing the compression housing to only slideably travel along the guide from its first side to its second side.

3. The tail vise of claim 2, wherein the threaded vise rod is connected to the compression housing through the use of a plate attached to the first portion that allows the vise rod to spin freely, but fixes the compression housing's position in relation to the vise rod.

4. The tail vise of claim 3, wherein the longitudinally extending guide, compression housing and threaded vice rod are constructed from a material chosen from a group including wood, plastic, metal, composite materials, and any other applicable material known to one versed in the prior art.

* * * * *